US007040908B2

(12) United States Patent
Kamata

(10) Patent No.: US 7,040,908 B2
(45) Date of Patent: May 9, 2006

(54) CARD CONNECTOR WHICH CAN BE CONNECTED TO A PLURALITY OF KINDS OF CARDS DIFFERENT IN WIDTH

(75) Inventor: Kazushi Kamata, Aomori (JP)

(73) Assignees: Japan Aviation Electronics Industry, Limited, Tokyo (JP); JAE Hirosaki, Ltd., Hirosaki (JP)

( * ) Notice: Subject to any disclaimer, the term of this patent is extended or adjusted under 35 U.S.C. 154(b) by 0 days.

(21) Appl. No.: 11/028,764

(22) Filed: Jan. 4, 2005

(65) Prior Publication Data

US 2005/0148222 A1 Jul. 7, 2005

(30) Foreign Application Priority Data

Jan. 6, 2004 (JP) ..... 2004-001222

(51) Int. Cl.
*H01R 13/62* (2006.01)

(52) U.S. Cl. ..... 439/159; 439/541.5

(58) Field of Classification Search ..... 439/159, 439/152, 160, 155, 541.5, 64; 361/801, 740
See application file for complete search history.

(56) References Cited

U.S. PATENT DOCUMENTS

| | | | | |
|---|---|---|---|---|
| 5,655,918 | A * | 8/1997 | Soh | 439/159 |
| 5,928,017 | A * | 7/1999 | Lan | 439/159 |
| 6,056,566 | A * | 5/2000 | Nakamura et al. | 439/159 |
| 6,102,708 | A * | 8/2000 | Kimura | 439/64 |
| 6,115,244 | A * | 9/2000 | Chen et al. | 361/684 |
| 6,168,446 | B1 * | 1/2001 | Tung | 439/159 |

* cited by examiner

*Primary Examiner*—Hien Vu
(74) *Attorney, Agent, or Firm*—Collard & Roe, P.C.

(57) ABSTRACT

In a card connector having a base member defining a receiving portion for receiving a predetermined card in a first direction, an eject mechanism including two eject plates arranged on the base member. The eject plates are adjacent to each other in a second direction and independently movable in the first direction. Each of the eject plates is for transmitting a removing force to the predetermined card. A support plate is engaged with the eject plates in the first direction and movable in the second direction. A plate support point portion is connected to the base member and adapted to be engaged with a part of the support plate in the first direction to serve as a support point of the support plate when the support plate is located on one side in the first direction. In addition, a plurality of contacts are held by the base member.

9 Claims, 7 Drawing Sheets

CARD CONNECTOR WHICH CAN BE CONNECTED TO A PLURALITY OF KINDS OF CARDS DIFFERENT IN WIDTH

This application claims priority to prior Japanese patent application JP 2004-1222, the disclosure of which is incorporated herein by reference.

BACKGROUND OF THE INVENTION

This invention relates to a card connector.

In recent years, cards such as IC cards are widely used in various fields. These cards are not uniform in size. A plurality of kinds of cards different, for example, in width are proposed and used.

In order to write and read information into and from a card of the type, a card connector is used. For example, an existing card connector comprises a base member defining a receiving portion for receiving the card, a plurality of contacts held by the base member, and an eject mechanism for removing the card from the receiving portion. The eject mechanism comprises an eject plate to be engaged with the card when the card is ejected, a support plate for operating the eject plate, and an eject lever for operating the support plate.

The existing card connector can be connect to only one kind of card. Therefore, in order to deal with a plurality of kinds of cards different in width, a plurality of kinds of card connectors are required. Thus, the existing card connector is inconvenient.

SUMMARY OF THE INVENTION

It is therefore an object of this invention to provide a card connector which can be connected to a plurality of kinds of cards different in width.

Other objects of the present invention will become clear as the description proceeds.

According to an aspect of the present invention, there is provided a card connector adapted to connect a predetermined card, the card connector comprising a base member defining a receiving portion for receiving the predetermined card, a plurality of contacts held by the base member; and an eject mechanism for removing the predetermined card from the receiving portion in a first direction, the eject mechanism comprising two eject plates arranged on the base member to be adjacent to each other in a second direction perpendicular to the first direction and independently movable in the first direction, the eject plates being for transmitting a removing force to the predetermined card, a support plate engaged with the eject plates in the first direction and movable in the second direction, and a plate support point portion connected to the base member and adapted to be engaged with a first part of the support plate in the first direction to serve as a support point of the support plate when the support plate is located on one side in the first direction.

DESCRIPTION OF THE PREFERRED EMBODIMENT

Figure 1:
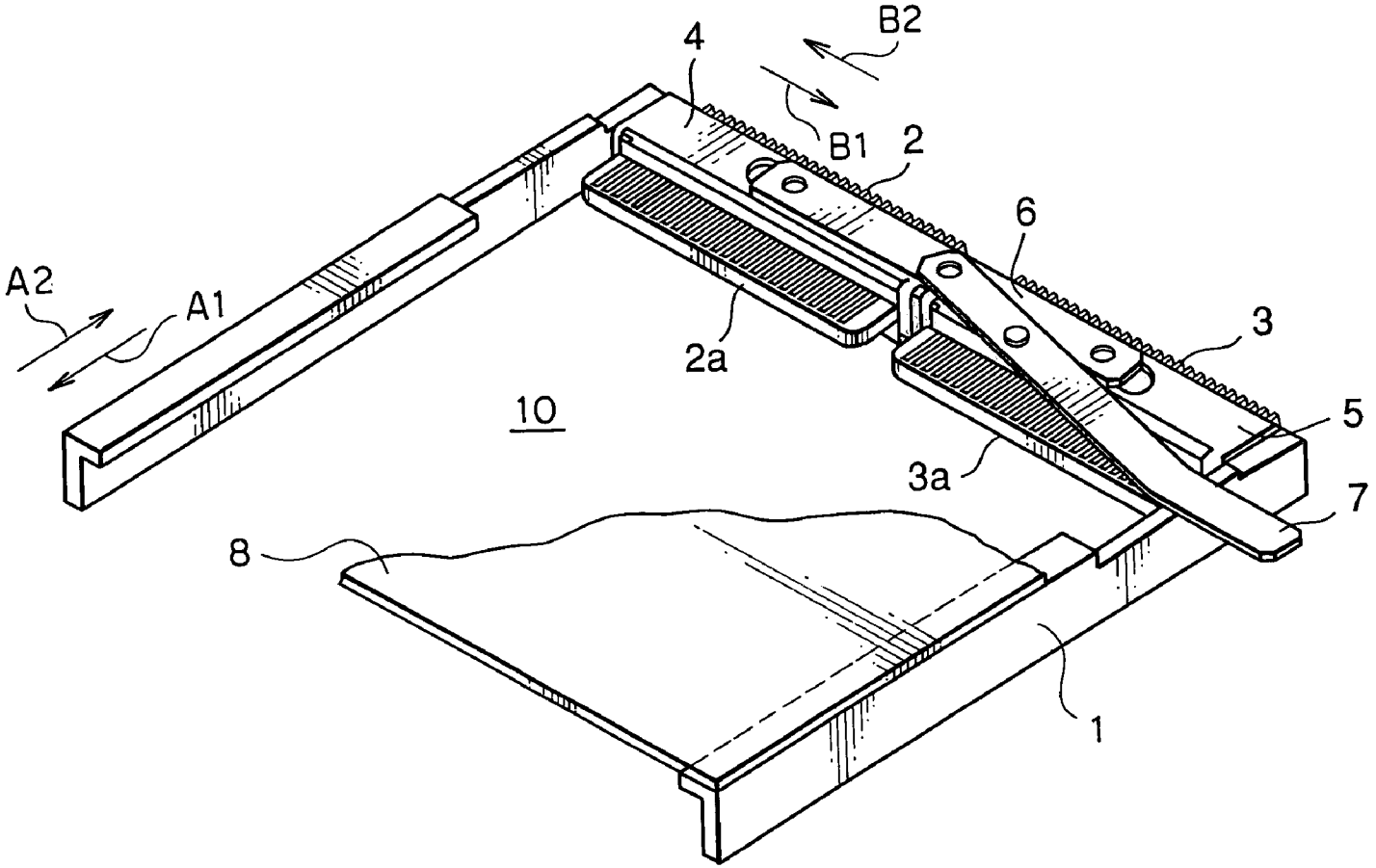
FIG. 1 is a perspective view of a card connector according to one embodiment of this invention with a cover partially cut away.
Figure 2:
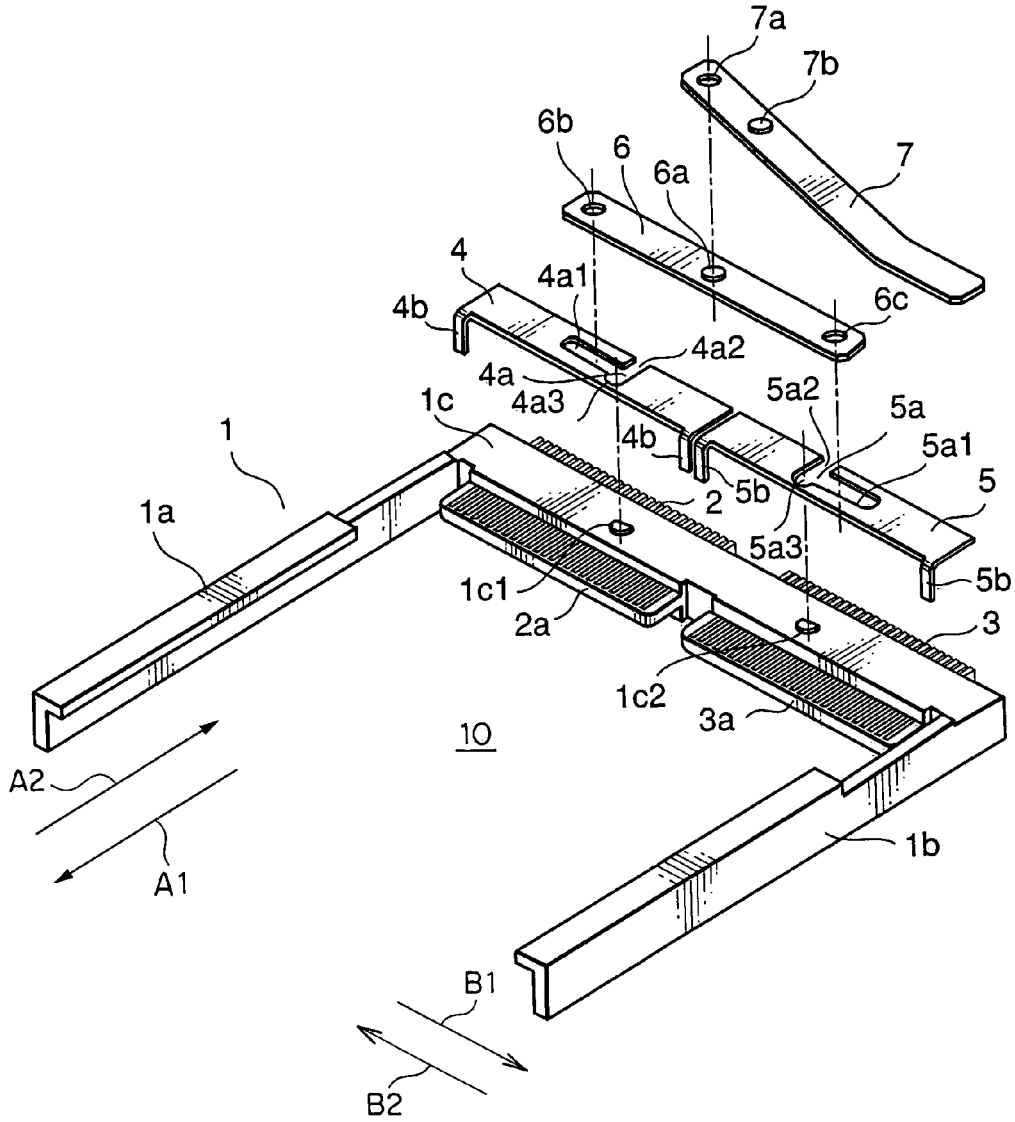
FIG. 2 is an exploded perspective view of the card connector in FIG. 1 without the cover.
Figure 3:
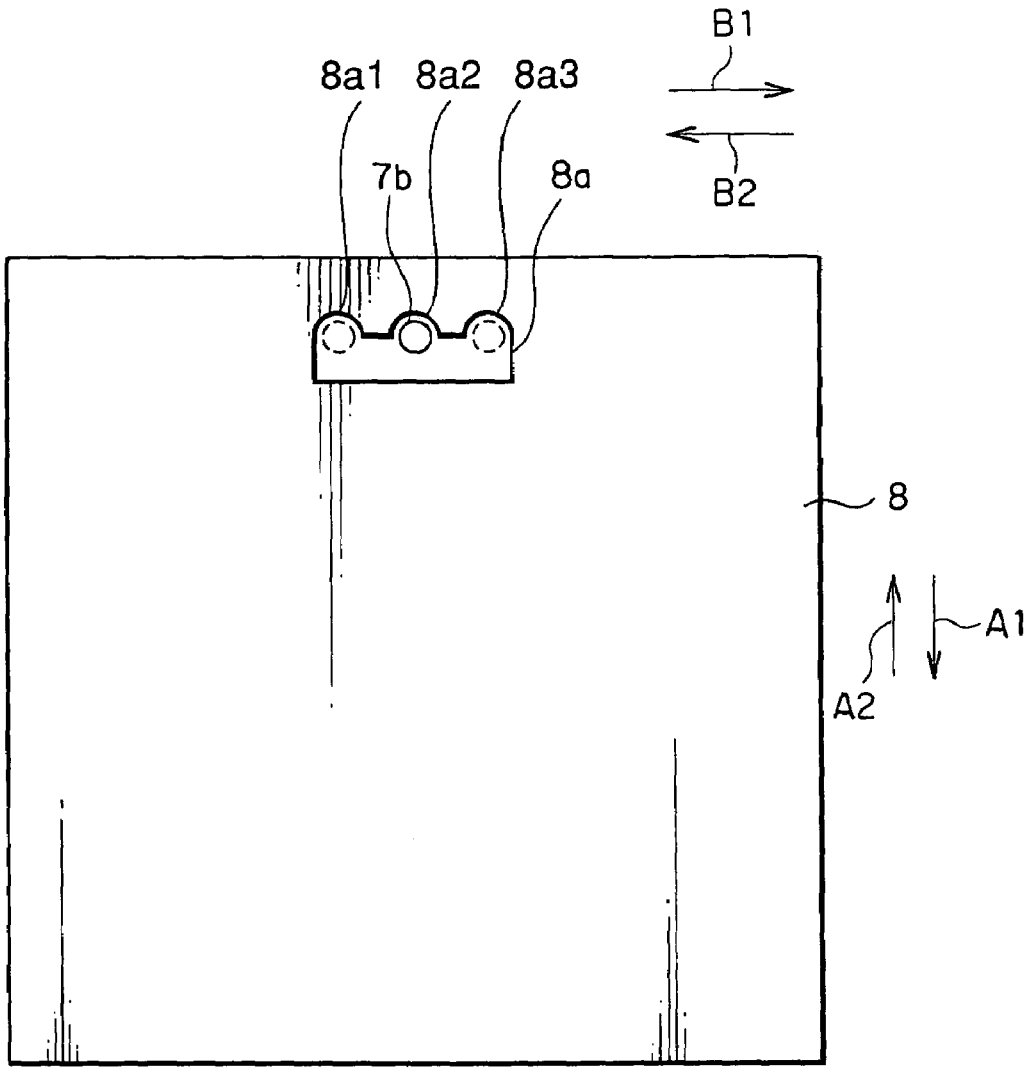
FIG. 3 is a plan view of the cover of the card connector in FIG. 1.

Referring to FIGS. 1 through 3, description will be made of a card connector according to one embodiment of the present invention. The card connector is adapted to selectively use two kinds of IC cards different in width.

As shown in FIGS. 1 and 2, a card connector comprises a generally U-shaped insulator 1, two contact sets 2 and 3 held by the insulator 1 to be movable in a first direction A (including a card removing direction A1 and a card inserting direction A2), a pair of eject plates 4 and 5 symmetrical in structure with each other for removing an IC card (not shown), a support plate 6 for moving the eject plates 4 and 5 in the card removing direction A1, an eject lever 7 for moving the support plate 6 in the card removing direction A1 and a second direction B (including a rightward direction B1 and a leftward direction B2) perpendicular to the first direction A, and a cover 8.

The insulator 1 has opposite side portions 1*a* and 1*b* and a linking portion 1*c* connecting the opposite side portions 1*a* and 1*b*. The linking portion 1*c* is provided with a pair of semispherical protrusions 1*c*1 and 1*c*2 formed at two positions on its upper surface to serve as plate support point portions. The linking portion 1*c* holds the two contacts sets 2 and 3.

The eject plate 4 and 5 are arranged adjacent to each other in the second direction B. The eject plates 4 and 5 have generally L-shaped grooves 4*a* and 5*a* formed at their centers, respectively. The generally L-shaped grooves 4*a* and 5*a* have long groove portions 4*a*1 and 5*a*1 extending in the second direction B, short groove portions 4*a*2 and 5*a*2 connected to the long groove portions 4*a*1 and 5*a*1 and extending in the first direction A, and inner portions 4*a*3 and 5*a*3 formed at inner ends of the short groove portions 4*a*2 and 5*a*2, respectively. The eject plates 4 and 5 have pressing portions 4*b* and 5*b* formed as bent portions on front sides thereof to press the card or cards at opposite ends thereof, respectively.

The support plate 6 extends in the second direction B on the eject plates 4 and 5. The support plate 6 has a protrusion 6*a* formed at the center of its upper surface and protrusions 6*b* and 6*c* formed on its lower surface at positions near opposite ends, respectively.

The eject lever 7 has a hole 7*a* formed near its one end. The eject lever 7 has a protrusion 7*b* formed on its upper surface at a position slightly separate from the hole 7*a* to serve as a lever support point portion.

The insulator 1 is covered with the cover 8 on its upper surface. As shown in FIG. 3, the cover 8 has a long hole 8*a* extending in the second direction B. The long hole 8*a* is provided with holding portions 8*a*1, 8*a*2, and 8*a*3 arranged at three positions thereof and aligned in the second direction B. Each of the holding portions 8*a*1, 8*a*2, and 8*a*3 is adapted to hold the protrusion 7*b* which serve as the support point portion when the eject lever 7 is rotated. A combination of the cover 8 and the insulator 1 serves as a base member defining a receiving portion 10 for receiving the IC card.

Referring to FIGS. 1 and 2, description will be made of a method of assembling the card connector. At first, the eject plates 4 and 5 are fitted to the insulator 1 at a position illustrated in FIG. 1. At this time, the inner portions 4*a*3 and 5*a*3 of the generally L-shaped grooves 4*a* and 5*a* of the eject plates 4 and 5 are fitted over the protrusions 1*c*1 and 1*c*2, respectively. Next, the protrusions 6*b* and 6*c* of the support plate 6 are inserted into the long groove portions 4*a*1 and 5*a*1 of the generally L-shaped grooves 4*a* and 5*a* of the eject plates 4 and 5, respectively, and are placed on the eject plates 4 and 5 to be bridged therebetween. Then, the hole 7*a* of the eject lever 7 is fitted over the protrusion 6*a* of the support plate 6. Further, the cover 8 is put on the insulator 1 to cover the receiving portion 10. In this event, the protrusion 7*b* of the eject lever 7 is held by one of the holding portions 8*a*1, 8*a*2, and 8*a*3 at the three positions of the long hole 8*a* of the cover 8. The detail will later be described.

The IC card (not shown) is inserted by fingers of an operator into the card receiving portion 10 of the card connector. The IC card may be an IC card 11 having a predetermined size or an IC card 12 having a large size twice the predetermined size.

Figure 4A:
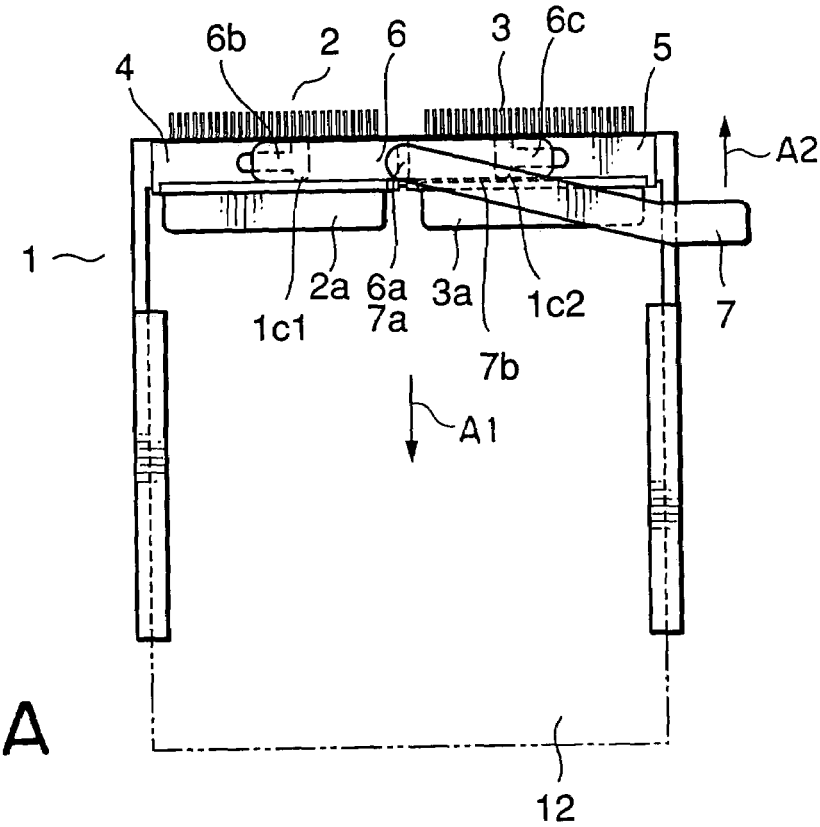
FIG. 4A is a plan view of the card connector in FIG. 1 when a card having a largest width is connected thereto.
Figure 4B:
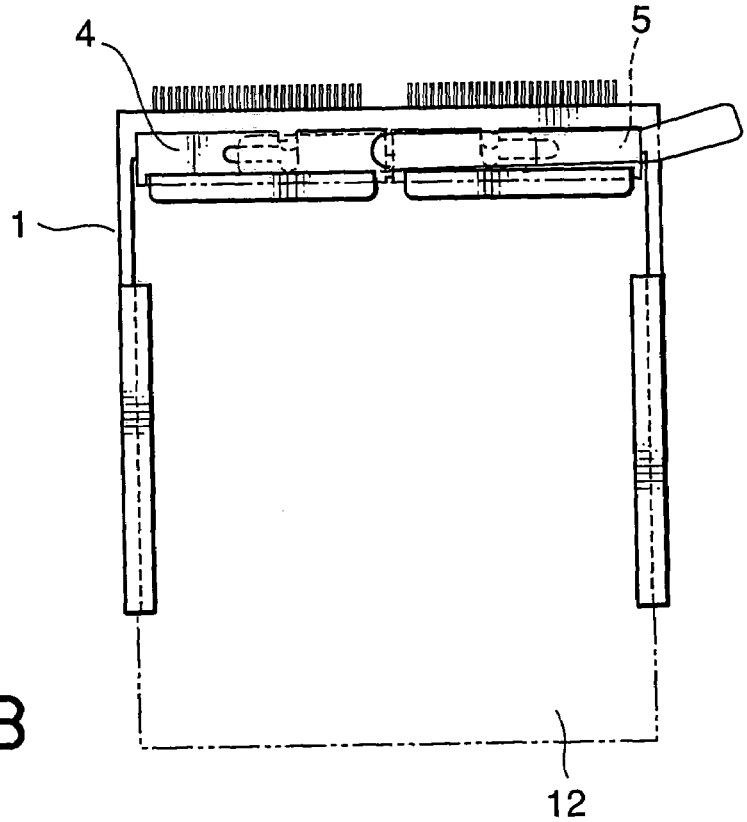
FIG. 4B is a plan view of the card connector in FIG. 1 when the card is disconnected and removed therefrom.

Referring to FIGS. 4A and 4B in addition to FIGS. 1 through 3, description will be made of the case where the IC card 12 having a large size twice the predetermined size is dealt with.

In FIG. 4A, the IC card 12 is inserted into and connected to the card connector. In this state, the protrusion 7*b* of the eject lever 7 is held by the holding portion 8*a*2 of the cover 8 as shown in FIG. 3.

In order to remove the IC card 12 from the card connector, the eject lever 7 is pushed in the card inserting direction A2 to be rotated around the protrusion 7*b*. Since the hole 7*a* of the eject lever 7 is fitted over the protrusion 6*a* of the support plate 6, the support plate 6 is moved in the card removing direction A1. At this time, the protrusions 6*b* and 6*c* of the support plate 6 are not brought into contact with the protrusions 1*c*1 and 1*c*2 of the insulator 1. Therefore, the protrusions 6*b* and 6*c* move the eject plates 4 and 5 in the card removing direction A1 so that the pressing portions 4*b* of the eject plate 4 and the pressing portions 5*b* of the eject plate 5 push an end portion of the IC card 12 in the card removing direction A2. Consequently, as illustrated in FIG. 4B, a connecting portion (not shown) of the IC card 12 is disconnected from connecting portions 2*a* and 3*a* of the contact sets 2 and 3 and the IC card 12 is ejected from the card connector.

Referring to FIGS. 5A, 5B, 6A, and 6B in addition to FIGS. 1 through 3, description will be made of the case where the IC cards 11 having the predetermined size are dealt with.

Figure 5A:
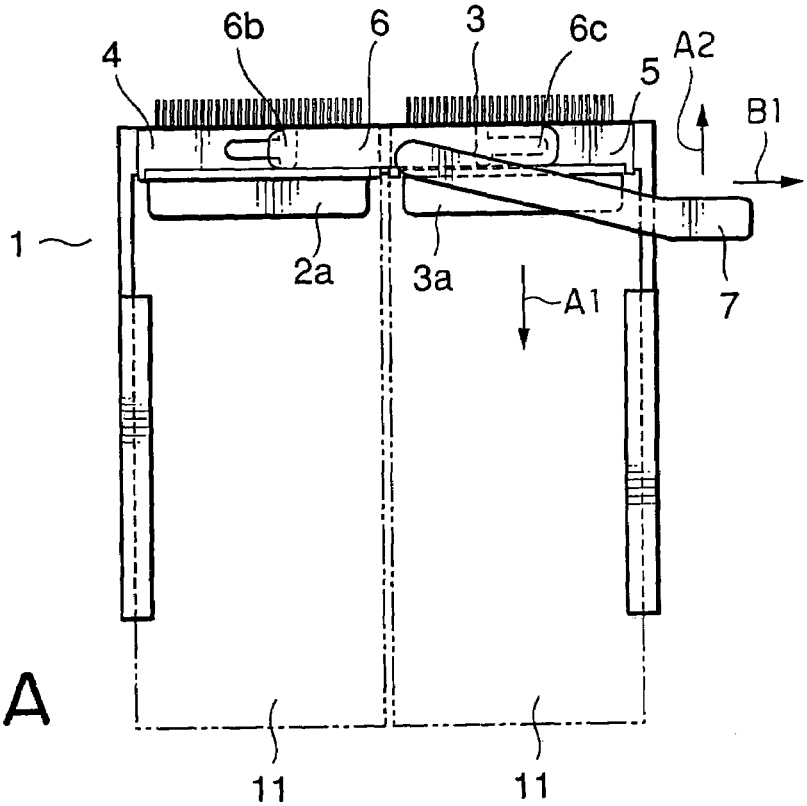
FIG. 5A is a plan view of the card connector in FIG. 1 when two cards having a small width are connected thereto.

FIG. 5A shows a first state where the IC cards 11 are inserted into and connected to the card connector. In the first state, the protrusion 7*b* is held by the holding portion 8*a*3 of the cover 8.

Prior to an operation of removing the IC card 11 of the predetermined size inserted on a right side of the insulator 1, the eject lever 7 is moved in the rightward direction B1, if necessary, to obtain the first state. The hole 7*a* of the eject lever 7 is fitted over the protrusion 6*a* of the support plate 6. Therefore, when the eject lever 7 is moved in the rightward direction B1, the support plate 6 is also moved in the rightward direction B1. As a result, the protrusion 6*b* is moved to a position allowing or causing the protrusion 6*b* to be brought into contact with the protrusion 1*c*1 of the insulator 1 when the support plate 6 is moved in the card removing direction A1. In other words, the protrusion 6*b* of the support plate 6 is faced to the protrusion 1*c*1 of the insulator 1 in the first direction A.

Figure 5B:
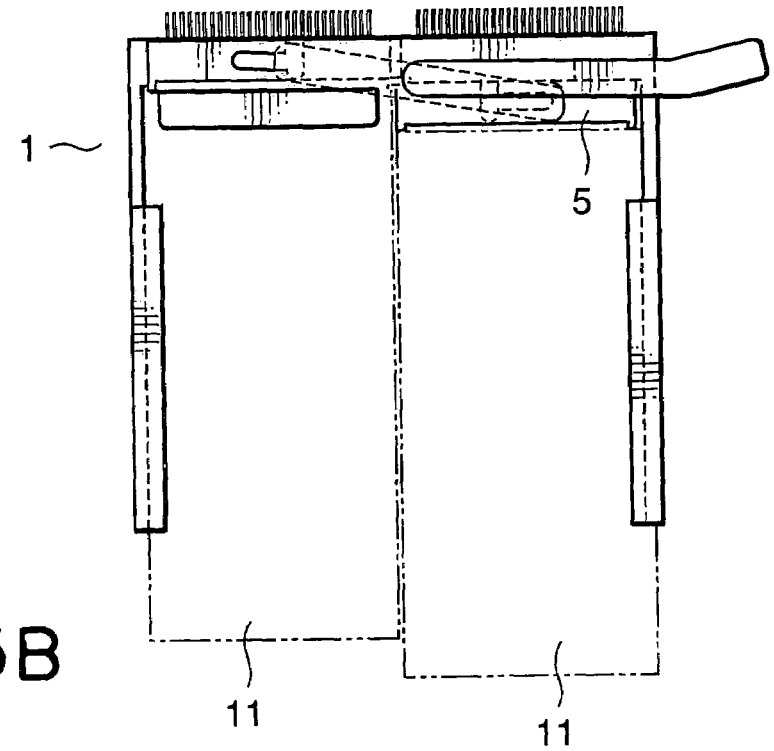
FIG. 5B is a plan view of the card connector in FIG. 1 when one of the two cards is disconnected therefrom.

In order to remove the IC card 11 from the card connector, the eject lever 7 is pushed in the card inserting direction A2 to be rotated around the protrusion 7*b*. Since the hole 7*a* is fitted over the protrusion 6*a* of the support plate 6, the support plate 6 is driven in the card removing direction A1. However, because the protrusion 6*b* is brought into contact with the protrusion 1*c*1, the support plate 6 is rotated around the protrusion 6*b* in a clockwise direction in FIG. 5A. Therefore, the protrusion 6*c* moves the eject plate 5 in the card removing direction A1 so that the pressing portions 5*b* of the eject plate 5 push an end portion of the right-side IC card 11 in the card removing direction A1. Consequently, as illustrated in FIG. 5B, a connecting portion (not shown) of the right-side IC card 11 is removed from the connecting portion 3*a* of the contact set 3 and the right-side IC card 11 is ejected from the card connector.

Figure 6A:
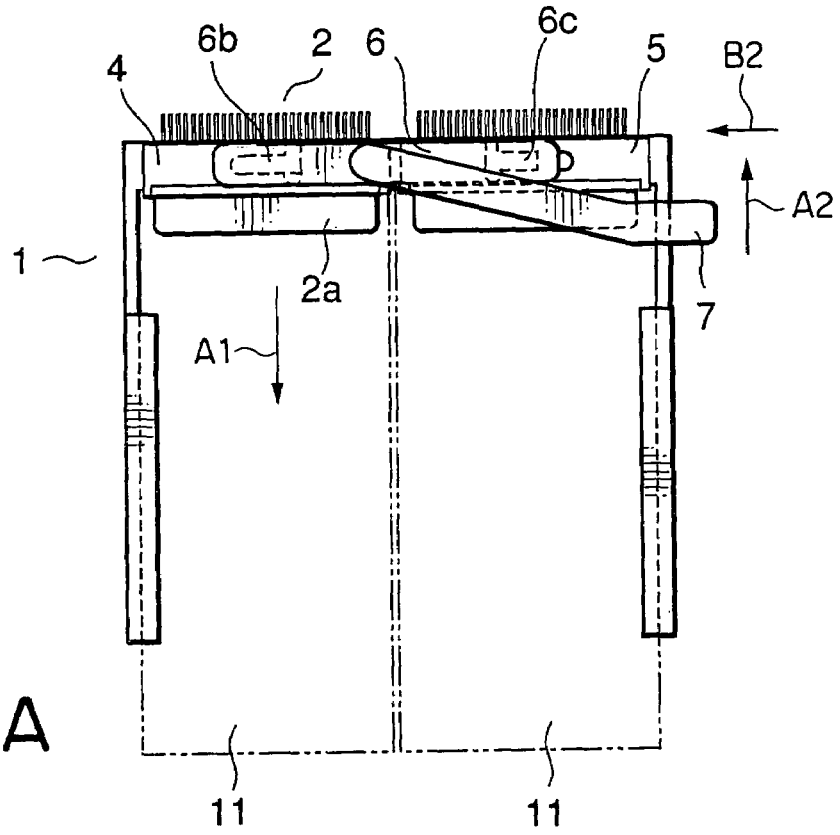
FIG. 6A is a plan view of the card connector in FIG. 1 when the two cards having a small width are connected thereto.

FIG. 6A shows a second state where the IC cards 12 are inserted into and connected to the card connector. In the second state, the protrusion 7*b* is held by the holding portion 8*a*1 of the cover 8.

Prior to an operation of removing the IC card 11 of the predetermined size inserted on a left side of the insulator 1, the eject lever 7 is moved in the leftward direction B2, if necessary, to obtain the second state. The hole 7*a* of the eject lever 7 is fitted over the protrusion 6*a* of the support plate 6. Therefore, when the eject lever 7 is moved in the leftward direction B2, the support plate 6 is also moved in the leftward direction B2. As a result, the protrusion 6*c* is moved to a position allowing or causing the protrusion 6*c* to be brought into contact with the protrusion 1*c*2 of the insulator 1 when the support plate 6 is moved in the card removing direction A1. In other words, the protrusion 6*c* of the support plate 6 is faced to the protrusion 1*c*2 of the insulator 1 in the first direction A.

Figure 6B:
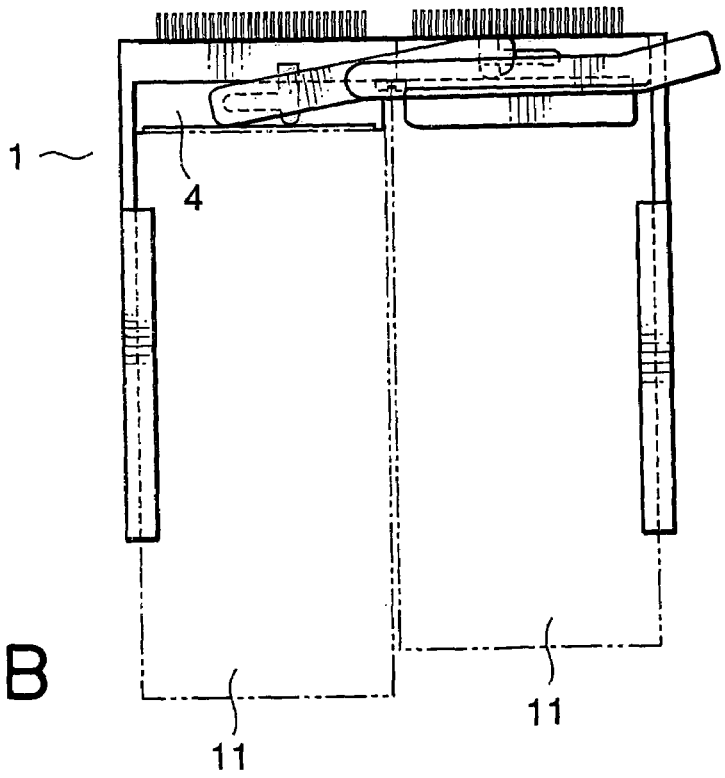
FIG. 6B is a plan view of the card connector in FIG. 1 when the other one of the two cards is disconnected therefrom.
Figure 7:
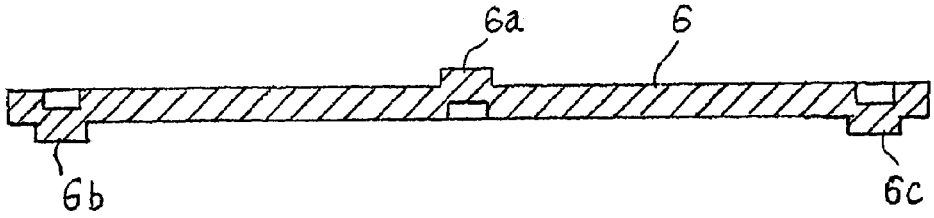
FIG. 7 is an enlarged sectional view of the support plate shown in FIG. 2.

In order to remove the IC card 11 from the card connector, the eject lever 7 is pushed in the card inserting direction A2 to be rotated around the protrusion 7*b*. Since the hole 7*a* is fitted over the protrusion 6*a* of the support plate 6, the support plate 6 is driven in the card removing direction A1. However, because the protrusion 6*c* is brought into contact with the protrusion 1*c*2, the support plate 6 is rotated around the protrusion 6*c* in a counterclockwise direction in FIG. 6A. Therefore, the protrusion 6*b* moves the eject plate 4 in the card removing direction A1 so that the pressing portions 4*b* of the eject plate 4 push an end portion of the left-side IC card 11 in the card removing direction A1. Consequently, as illustrated in FIG. 6B, a connecting portion (not shown) of the left-side IC card 11 is removed from the connecting portion 2*a* of the contact set 2 and the left-side IC card 11 is ejected from the card connector.

An operation of simultaneously removing the two IC cards 11 of the predetermined size is similar to that described in conjunction with FIGS. 4A and 4B where the IC card 12 of the large size twice the predetermined size is dealt with.

The above-mentioned card connector is adapted to connect two or three kinds of cards different in width. It is therefore possible to reduce the number of kinds of card connectors required to deal with various kinds of cards. Further, the card connector is convenient in that the two cards except the card having a largest width may be or may not be equal in width to each other and can be inserted and removed either individually or simultaneously. Since the card connector can be produced by slightly modifying an insulator, eject plates, the support plate, and an eject lever which have generally been used, the number of parts is not increased and the structure is simple without an increase in cost.

While this invention has thus far been described in connection with the preferred embodiment thereof, it will be readily possible for those skilled in the art to put this invention into practice in various other manners without departing from the scope set forth in the appended claims. In the foregoing, the IC card 12 has a width twice as large as that of the IC card 11. Alternatively, the right-hand IC card 11 and the left-hand IC card 11 may be different in width from each other. For example, the widths of the IC card 12, the right-hand IC card 11, and the left-hand IC card 11 may have a ratio of 3:1:2 or 5:2:3. As the cover 8, an existing shell may be used.

What is claimed is:

1. A card connector adapted to connect a predetermined card, the card connector comprising:

a base member defining a receiving portion for receiving the predetermined card;

a plurality of contacts held by the base member; and an eject mechanism for removing the predetermined card from the receiving portion in a first direction, the eject mechanism comprising:

two eject plates arranged on the base member to be adjacent to each other in a second direction perpendicular to the first direction and independently movable in the first direction, the eject plates being for transmitting a removing force to the predetermined card;

a support plate engaged with the eject plates in the first direction and movable in the second direction;

a first plate support point portion connected to the base member and adapted to be engaged with a first part of the support plate in the first direction to serve as a support point of the support plate when the support plate is located on one side in the second direction, an eject lever having a lever support point portion engaged with the base member and a lever rotating portion engaged with the support plate between the first and the second parts, the eject lever having a structure in which a position of the lever support point portion is changeable in the second direction, wherein the base member comprises:

an insulator holding the contacts; and a cover connected to the insulator and covering one surface of the receiving portion;

the cover having a plurality of holding portions aligned in the second direction, the lever support point portion being rotatably engaged with a selected one of the holding portions.

2. The card connector according to claim 1, further comprising a second plate support point portion connected to the base member and adapted to be engaged with a second part of the support plate in the first direction to serve as a support point of the support plate when the support plate is located on another side in the second direction.

3. The card connector according to claim 2, wherein, when the support plate is located between the one side and the other side, the first and the second parts of the support plate do not engage with the first and second plate support point portions, whereby the support point is not formed.

4. The card connector according to claim 1, wherein the number of holding portions is equal to three, the support plate being located at the one side when the lever support point portion is engaged with the holding portion at one end, the support plate being located at the other side when the lever support point portion is engaged with the holding portion at the other end, the support plate being located at a position between the one side and the other side when the lever support point portion is engaged with the holding portion at the center.

5. The card connector according to claim 1, wherein the cover has a long hole extending in the second direction, the holding portions being arranged along the long hole.

6. A card connector adapted to connect a predetermined card, the card connector comprising:

a base member defining a receiving portion for receiving the predetermined card;

a plurality of contacts held by the base member; and an eject mechanism for removing the predetermined card from the receiving portion in a first direction, the eject mechanism comprising:

two eject plates arranged on the base member to be adjacent to each other in a second direction perpendicular to the first direction and independently movable in the first direction, the eject plates being for transmitting a removing force to the predetermined card;

a support elate engaged with the eject plates in the first direction and movable in the second direction; and a plate support point portion connected to the base member and adapted to be engaged with a first part of the support plate in the first direction to serve as a support point of the support plate when the support plate is located on one side in the second direction, wherein each of the eject plates has a generally L-shaped groove, the generally L-shaped groove having a long groove portion extending in the second direction, a short groove portion connected to the long groove portion and extending in the first direction, and an inner portion formed at an inner end of the short groove portion, the plate support point portion having a protrusion located at the inner portion, the support plate having a protrusion inserted into the long groove portion.

7. The card connector according to claim 6, wherein the base member comprises:

an insulator holding the contacts; and a cover connected to the insulator and covering one surface of the receiving portion;

the plate support point portion protruding from the insulator.

8. The card connector according to claim 7, wherein the protrusion of the support plate is engaged with the protrusion of the plate support point portion in the first direction when the support plate is located on the one side.

9. A card connector adapted to connect a predetermined card, the card connector comprising:

a base member defining a receiving portion for receiving the predetermined card;

a plurality of contacts held by the base member; and an eject mechanism for removing the predetermined card from the receiving portion in a first direction, the eject mechanism comprising:

two eject plates arranged on the base member to be adjacent to each other in a second direction perpendicular to the first direction and independently movable in the first direction, the eject plates being for transmitting a removing force to the predetermined card;

a support plate engaged with the eject plates in the first direction and movable in the second direction; and a plate support point portion connected to the base member and adapted to be engaged with a first part of the support plate in the first direction to serve as a support point of the support plate when the support plate is located on one side in the second direction, wherein the contacts are divided into two contact sets in the second direction in one-to-one correspondence to the eject plates, wherein each of the two contact sets is adapted to be connected to a small card having a small size in the second direction as the predetermined card, the two contact sets being adapted to be connected to a large card having a large size in the second direction as the predetermined card in cooperation with each other.

* * * * *